United States Patent [19]

Kanfer

[11] Patent Number: 4,582,227

[45] Date of Patent: Apr. 15, 1986

[54] PUMP DISPENSER ASSEMBLY

[75] Inventor: Joseph S. Kanfer, Akron, Ohio

[73] Assignee: Go-Jo Industries, Inc., Cuyahoga Falls, Ohio

[21] Appl. No.: 519,323

[22] Filed: Aug. 1, 1983

[51] Int. Cl.[4] ..... B67D 5/06

[52] U.S. Cl. ..... 222/153; 222/180; 222/383; 248/312.1

[58] Field of Search ..... 239/282, 283; 248/311.2, 312.1, 312, 311.3; 222/130, 131, 160, 162, 164, 165, 173, 180, 320, 321, 325, 372, 383, 385, 464, 153

[56] References Cited

U.S. PATENT DOCUMENTS

| | | | |
|---|---|---|---|
| Re. 24,312 | 1/1955 | Lippman et al. | 222/181 |
| 1,409,790 | 3/1922 | Schwarcz | 222/544 X |
| 2,815,994 | 12/1957 | Lippman et al. | 309/23 |
| 3,072,297 | 1/1963 | Lippman et al. | 222/181 |
| 3,349,967 | 10/1967 | Schneller | 222/180 X |
| 3,419,194 | 12/1968 | Lippman et al. | 222/390 |
| 3,788,584 | 1/1974 | Deike | 248/311.2 X |
| 3,814,294 | 6/1974 | Stevenson | 222/181 |
| 3,833,149 | 9/1974 | Iozzio | 222/70 |
| 3,844,444 | 10/1974 | Carroll | 248/311.2 X |
| 3,926,347 | 12/1975 | Low et al. | 222/185 |
| 4,018,363 | 4/1977 | Cassia | 222/80 |
| 4,039,104 | 8/1977 | Mijares, Jr. et al. | 222/144.5 |
| 4,146,156 | 3/1979 | Cassia | 222/181 |
| 4,149,573 | 4/1979 | Cassia | 141/18 |
| 4,162,747 | 7/1979 | Graf | 222/185 |
| 4,258,865 | 3/1981 | Vahl et al. | 222/213 |
| 4,280,638 | 7/1981 | Keihm | 222/180 |
| 4,349,133 | 9/1982 | Christine | 222/183 |
| 4,457,445 | 7/1984 | Hanks et al. | 220/214 |

FOREIGN PATENT DOCUMENTS

| | | | |
|---|---|---|---|
| 2390664 | 12/1978 | Fed. Rep. of Germany | 248/312 |
| 1486895 | 9/1977 | United Kingdom | 248/312 |

*Primary Examiner*—Joseph J. Rolla
*Assistant Examiner*—Michael S. Huppert
*Attorney, Agent, or Firm*—Reese Taylor

[57] ABSTRACT

A pump dispenser assembly for dispensing high viscosity material, such as soap, includes a wall mounting bracket; a top cover hingedly connected to the wall mounting bracket for movement between open and closed positions relative thereto; a pump sub-assembly releasably carried by the top cover; and a container for the soap or other material which cooperates with the just-named components so as to be supported by the wall mounting bracket and engaged by the top cover and pump assembly to be securely held within the assembly and yet easily removable therefrom for replacement purposes. To this end, the container is supported on the mounting bracket, has an engagement recess for engagement with a lip on the cover, and a cylindrical extension for engagement with the pump sub-assembly. The assembly also includes an attachment for quick disconnect attachment of the pump sub-assembly to the top cover so that worn or damaged pumps can be quickly and easily replaced without any tools of any type and without any modification or adjustment to the overall assembly. The hinge connection between the top cover and the mounting bracket is such that the assembly, which is normally mounted on a vertical wall, can be installed closely adjacent a connecting horizontal surface such as a counter top.

17 Claims, 8 Drawing Figures

PUMP DISPENSER ASSEMBLY

FIELD OF THE INVENTION

This invention relates, in general, to dispensers designed to dispense high viscosity material, such as liquid soap, and relates in particular to the type dispenser of this general nature which is wall mounted and supplied by replaceable containers or cartridges to replenish the soap supply.

DESCRIPTION OF THE PRIOR ART

There are a large number of dispensing assemblies for dispensing soap and similar high viscosity material. Many of these are designed to be wall mounted while some are designed to be free standing.

The free standing variety are well known to those skilled in this art and generally include a container and a threaded top which carries a spring loaded pump and nozzle so that depression of the pump will eject a measured amount of the material through the nozzle.

The wall mounted dispensers of the prior art fall into a number of general categories.

For example, Lippman et al U.S. Pat. Nos. 2,700,490; 2,815,994; 3,072,297; and 3,419,194 operate on a crank and screw principle in which a crank is employed to screw a piston down through the soap container to force the material out through a nozzle carried on the dispenser.

Another type of dispenser employs a manually actuated handle wherein a handle is pulled to engage a bowl or bubble in a flexible soap container to compress it and force the soap out through a nozzle. The soap is carried in a replaceable container. Examples of this type of soap dispensers can be seen in Cassia U.S. Pat. Nos. 4,018,363; 4,146,156; and 4,149,573.

Still another type of soap dispenser is primarily characterized as being the collapsible container or bellows type. These involve utilization of actuating handles or the cover of the assembly itself to squeeze or otherwise distort the container to force the soap out through a dispensing opening. Examples can be seen in Vahl U.S. Pat. No. 4,258,865 and Low U.S. Pat. No. 3,926,347.

Gravity type dispensers of this general nature employing a sliding valve are exemplified by Stevenson U.S. Pat. No. 3,814,294.

In some other variations, a rotary valve is employed and these types of dispensers can be seen in Mijares U.S. Pat. 4,039,104 and Tannehill U.S. Pat. No. 4,079,867.

A further variation can be seen in a coin operated dispenser such as illustrated by Iozzio U.S. Pat. No. 3,833,149. Finally, a typical refill container can be seen in Graf U.S. Pat. 4,162,747.

BRIEF DESCRIPTION OF THE INVENTION

While all of the containers or dispensers illustrated in the patents referred to above are presumably effective for the purposes for which they are designed, none of them really fully meets the criteria desirable for such a structure.

It is, accordingly, an object of this invention to produce a pump dispenser assembly which is capable of being wall mounted, present a pleasing aesthetic appearance, permit quick and easy removal of the replaceable cartridge or container for refill purposes while mounting the container securely within the assembly during use, and, finally, to permit quick and easy replacement of the pump which is, of course, the only "wear" item in the whole assembly and the only component which is ordinarily susceptible to becoming inoperative.

In carrying out these general objects it has been found that a pump dispenser assembly effectively meeting the objects set forth above can be constructed of light weight plastic material so as to be economical but functionaly satisfactory.

Accordingly, it has been found that a wall mounting bracket can be provided for mounting to a vertical surface and including an offset top wall and a horizontally extending bottom wall. It has further been found that a top cover assembly can be provided and hingedly connected to the offset top portion of the wall mounting bracket.

It has further been discovered that this top cover can be provided with a cylindrical opening or seat to receive the pump itself and that quick disconnect means can be provided so that the pump can be readily and easily replaced in the top cover without the use of any tools and without any modification or adjustment to the overall assembly.

It has further been found that a unique container can be provided which is capable of engaging the pump assembly and being itself received and held in place by a combination of the bottom wall of the wall mounting bracket, the forward wall of the top cover, and the pump assembly attachment means.

Accordingly, production of a pump dispenser assembly of the character above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

Figure 1:
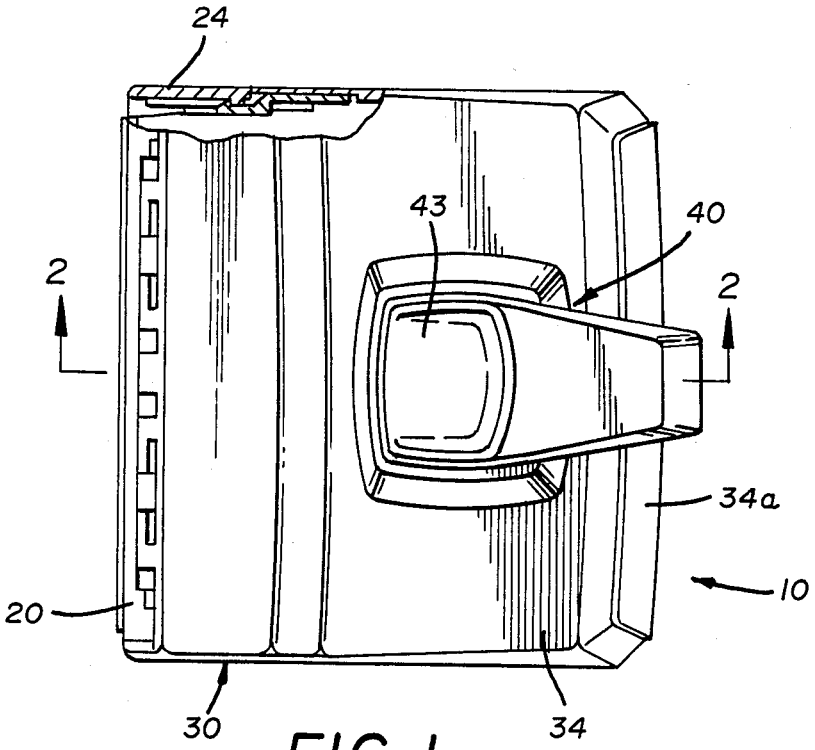
FIG. 1 is a top plan view of the improved pump dispenser assembly, partially broken away, in section.
Figure 2:
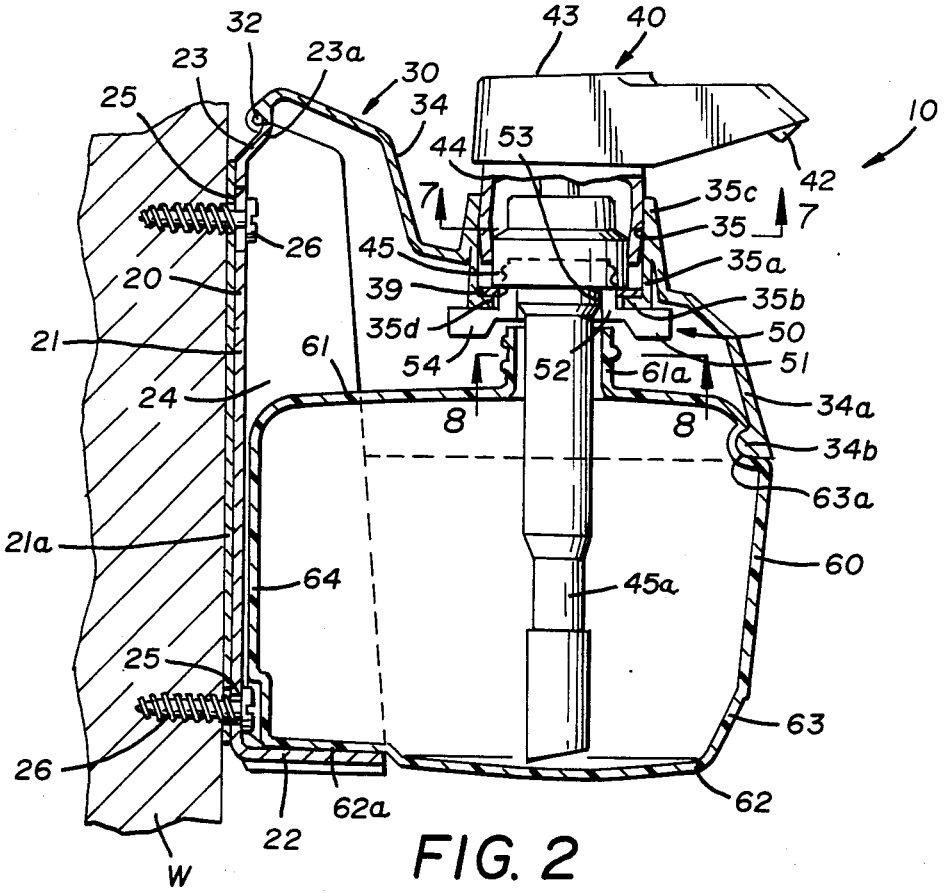
FIG. 2 is a sectional view, partially in section, taken along the line 2—2 of FIG. 1.
Figure 3:
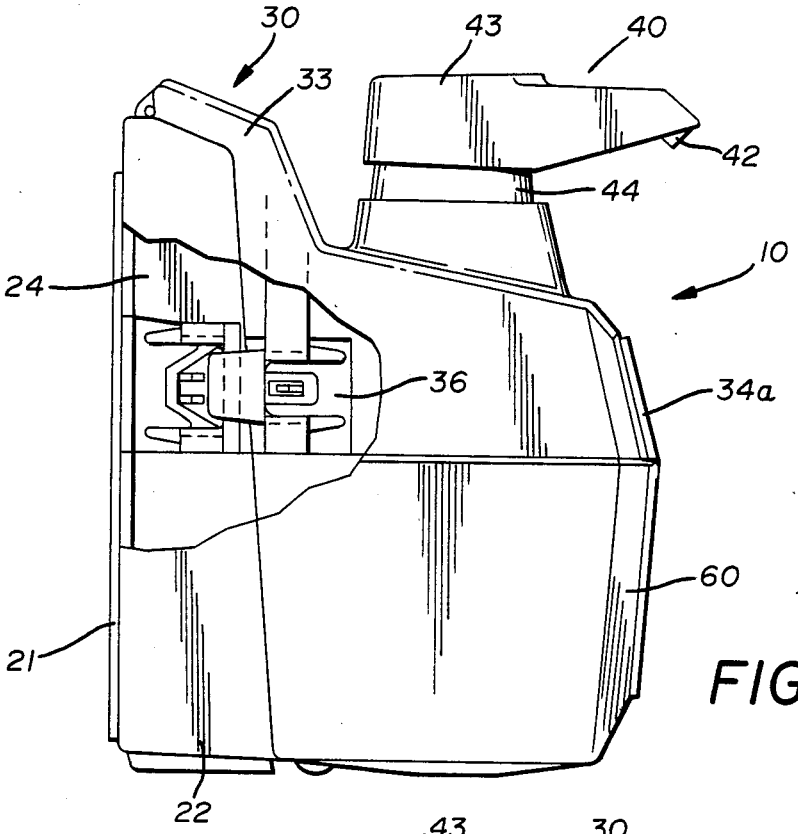
FIG. 3 is a side elevational view, partially broken away, and showing the locking means for securing the top cover to the wall mounting bracket.
Figure 4:
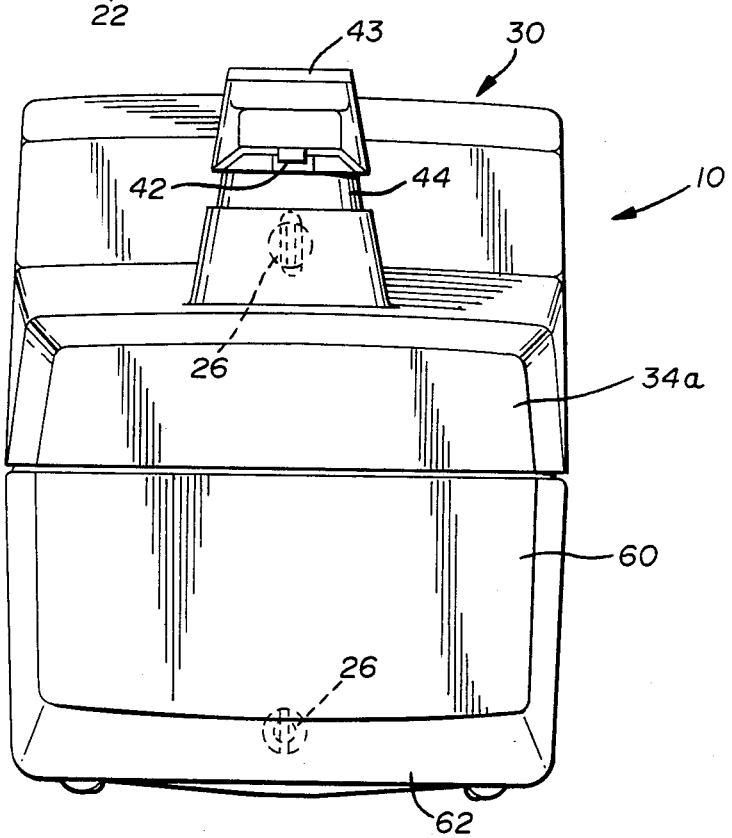
FIG. 4 is a front elevational view.

Referring first to FIGS. 1 and 2 of the drawings, it will be noted that the pump dispenser assembly of this invention, generally indicated by the numeral 10, includes a number of primary components, including a wall mounting bracket 20; a top cover 30; a pump assembly 40; attachment means 50; and a container 60 for the soap or other similar material.

Figure 5:
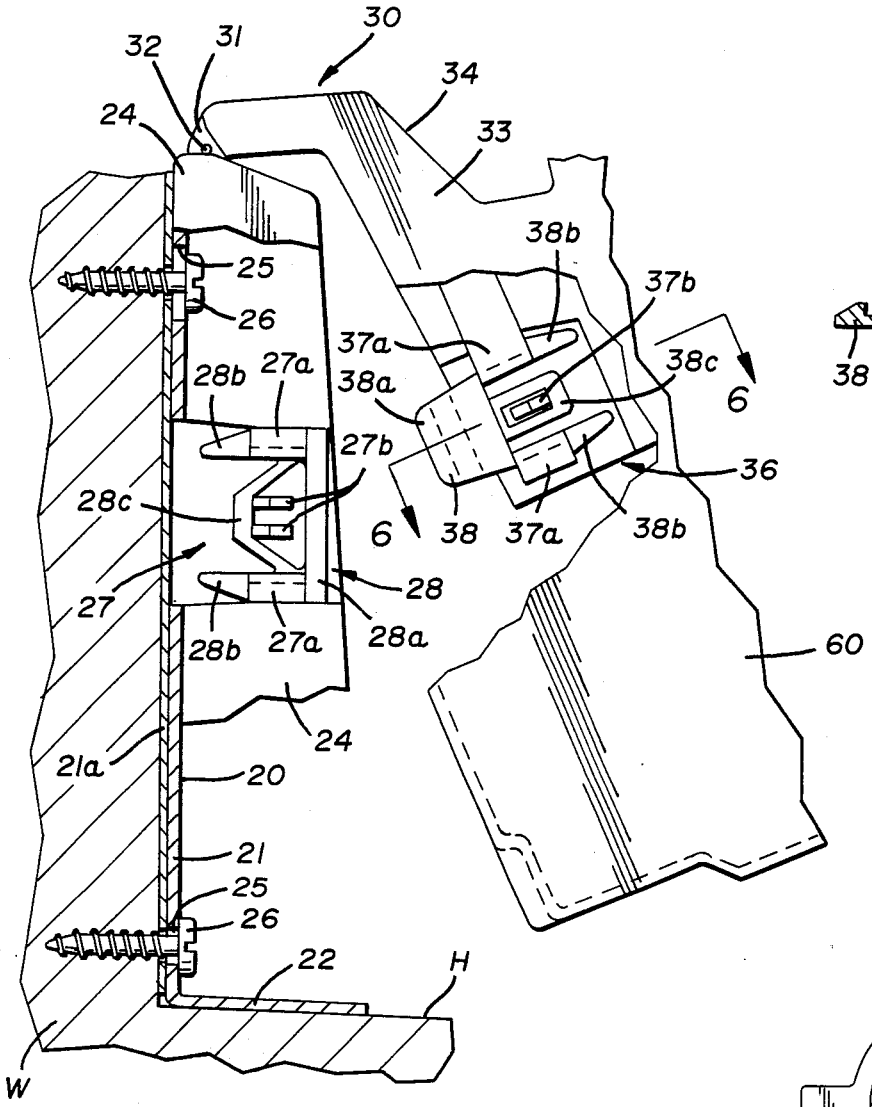
FIG. 5 is a side elevational view, partially broken away and in section, showing the assembly in an open condition.
Figure 6:
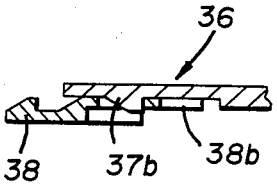
FIG. 6 is a sectional view taken along the line 6—6 of FIG. 5.
Figure 8:
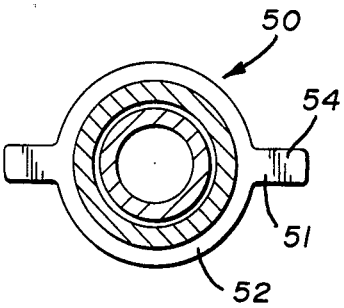
FIG. 8 is a sectional view taken along the line 8—8 of FIG. 2.
Figure 7:
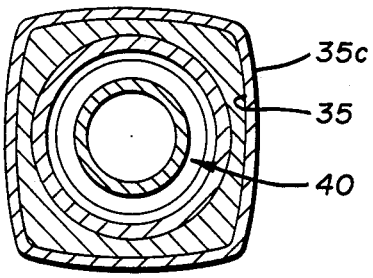
FIG. 7 is a sectional view taken along the line 7—7 of FIG. 2.

Referring next to FIGS. 1, 2 and 5 of the drawings, it will be seen that the wall mounting bracket 20 includes a generally flat, rectangular, central body portion 21 terminating in a top wall 23, which extends away from the plane of the central body portion 21 at an angle for a portion of its length and terminates in a vertical portion 23*a* parallel to the plane of the central body portion 21. Vertical portion 23*a* forms one leaf of a hinge, as will be subsequently described.

Also integral with the central body portion 21 is a bottom leg 22, which extends away from the central body portion substantially normally to the plane thereof in the same direction as the top wall 23. The wall mounting bracket 20 is completed by a pair of opposed side walls 24,24 as can be clearly seen in FIGS. 1 and 5 of the drawings and suitable apertures 25,25 in the central body portion 21 for reception of mounting screws 26,26. One surface of the body portion 21 also may carry a double faced adhesive 21*a* so that the assembly may be secured to the wall in that fashion, dispensing with the screws.

Attached to the wall mounting bracket 20, and specifically attached to its angularly offset top wall 23, is a top cover 30. One transverse edge 31 of this cover forms, with portion 23*a* of wall mounting bracket 20, the other leaf of the hinge. The top cover 30 is thus attached thereto by means of the hinge pin 32 so as to be movable between open and closed positions as will be described below.

The top cover 30 also includes opposed side walls 33,33 and a top wall 34 which includes a central opening 35 for receipt of the pump assembly 40, the seating of which will be described below. The opening 35 is formed by a downwardly extending cylindrical wall 35*a*, which terminates, at its bottom edge, in an inwardly directed annular lip 35*b* and an upwardly extending cylindrical wall 35*c*.

Top wall 34 of top cover 30 also has a downwardly directed forward or frontal area or portion 34*a* which terminates in an inwardly directed and transversely extending lip 34*b* for cooperation with container 60 for purposes which will be described below. It should be noted that lip 34*b* could be continuous from side wall to side wall or could be a series of lips spaced across the inner surface of frontal area 34*b*.

As noted above, attachment means 50 are also carried on the top cover 30 in association with pump receiving opening 35. These attachment means include the wing nut 51, which has a flat body 52, an integral, threaded, upwardly extending cylindrical projection 53 and integral tabs 54. The upwardly extending projection 53 passes through opening 35*d* formed by annular lip 35*b*. A retaining ring 39 is recevied about the upwardly extending projection 53.

The pump assembly 40, which is received in opening 32 and held there by attachment means 50, includes a dispensing spout 42 which is an extension of the cover and pressure member 43, which is, in turn, received within the pump collar 44. Pump collar 44 is then received within upwardly extending cylindrical wall 35*c* of top cover 30. The fit between wall 35*c* and collar 44 is such that the dispensing spout 42 is maintained in its proper orientation, i.e., toward the front of the assembly. The pump structure also includes a tube 45*a* which projects into the container 60, as illustrated in FIG. 2 of the drawings.

At this point, it will be noted that the pump assembly 40 has not been described in great detail since it is intended to be a conventional spring loaded pump, fairly well known in this art and any suitable pump of this general type may be employed.

However, such pump assemblies normally include a cap 45 which is internally threaded and which is adapted to engage the threaded portion of upwardly extending cylindrical projection 53 of the attachment means 50. In this way, the pump can be removed from the top cover by simply turning the wing nut 51 to release projection 53 from the cap 45, following which the entire pump assembly 40 can simply be lifted out and replaced by another pump assembly and secured in place by the wing nut 51 of attachment means 50. This is an important feature of the invention inasmuch as, with a fairly simple attachment structure of this type, the pump assembly, which is the only read "wear" item involved in the overall combination, can be replaced in a matter of seconds.

Referring next then to FIGS. 2, 3, 5 and 6 of the drawings, it will be noted that means are provided for locking the top cover to the wall mounting bracket in the closed position of FIG. 2. These means include elongate, male locking members 36 carried on the side walls 33,33, top cover, and female locking members 27 carried by the side walls 24 of the wall mounting bracket. These locking means are resiliently biased and automatically engaged when the cover is moved from the open position of FIG. 5 to the closed position of FIG. 2, for example.

Specifically, side walls 24 of the wall mounting bracket 20 each include integral flanges 27*a,27a* which are disposed on opposed sides of projections 27*b,27b*. A flexible clip 28 is provided having a base 28*a*, opposed legs 28*b,28b*, and an interconnecting central portion 28*c*. The clips are intended to be replacable and are positioned by passing legs 28*b,28b* under flanges 27*a,27a* with central portion 28*c* engaging projections 27*b,27b*.

Similarly, side walls 33 of top cover 30 each include integral flanges 37*a,37a* which are disposed on opposed sides of projection 37*b*. A flexible male clip 38 is provided with a locking base 38*a*, opposied legs 38*b,38b*, and an interconnecting central portion 38*c*. These clips are also intended to be replacable and are positioned by inserting legs 38*b,38b* under flanges 37*a,37a* and engaging projection 37*b* with central portion 38*c*.

It will be seen that top cover 30 can be locked to wall mounting bracket 20 by engaging base 38*a* with base 28*a*.

When it is desired to open the cover, it is merely necessary to slightly depress the side walls 33 of the top cover 30 to disengage central portions 28*a* and 38*a* and pivot the top cover about the hinge to move it back to the position of FIG. 5.

Turning next then to the container 60, it will be noted that this is a hollow, preferably transparent or translucent, container having a top wall 61 which has an upwardly extending neck or cylindrical projection 61*a*. That projection is preferably threaded on its exterior for engagement with a cap (not shown) so that the container can be rendered spill proof during transportation. When used in the combination, of course, the cap would be removed and discarded.

The container 60 also has an integral bottom wall 62 and front and rear walls 63 and 64. The front wall 63 has an inwardly and transversely extending recess 63*a* adjacent the juncture of top wall 61 and front wall 63, which is capable of being engaged by the inturned lip 34*b* of the frontal portion 34*a* of top cover 30 as clearly shown in FIG. 2 of the drawings. Container bottom wall 62 is preferably flat for at least a portion of its area (62*a*) and is capable of being received on the bottom leg 22 of the wall mounting bracket 20, as shown also in FIG. 2 of the drawings.

Bottom wall 62 tapers downwardly toward its midpoint so as to form a sump, thereby insuring maximum use of the contents of the container.

Finally, the upwardly extending projection 61*a* of container 60 has an internal diameter very close to the external diameter, or only slightly larger than, of the downwardly extending tube 45 of pump 40. In this fashion, when the container has its cap removed and is inserted into the assembly, the projection 61*a* tube 45 extends through projection 61*a*.

Furthermore, the transverse recess 63*a* of container 60 is engaged by the lip 34*b* and when the top cover 30 is moved to the closed position of FIG. 2, the portion 62*a* of bottom wall 62 of the container 60 rests on the leg 22 of the wall mounting bracket. In this way, the container is accurately located and stabley secured by at least three separate but cooperating means within the assembly.

Finally, once it has been installed to the condition of FIG. 2 of the drawings, with wall mounting bracket 20 secured to the wall W by screws 26,26, downward pressure on the member 43 of the pump will dispense a suitable amount of liquid through the nozzle 42.

It should be noted here that the offset hinge interconnection between the wall mounting bracket 20 and the cover 30 is such that the assembly can be mounted very close to or right on a horizontal surface H, such as a countertop, without impeding its effectiveness. As can be seen in FIG. 5, the cover 30 will swing out and away from the wall mounting bracket for replacement of the container 60, even if the bottom of mounting bracket leg 22 were to rest directly on the horizontal surface H.

This is a distinct advantge since mounting space is often at a premium and it is desirable to provide a dispenser which is adaptable to various mounting environments without reducing the efficiency and economy of the assembly.

It should also be noted that servicing of the assembly is greatly simplified as a result of the structural features just described.

For example, about the only areas in which wear or damage could occur would involve the cover-wall bracket locking and the pump. As already explained, clips 27 and 37 are readily replacable. Also, pump assembly 40 is easily replacable by manipulating attachment means 50. Both of these functions can be accomplished without removing the bracket 20 from the wall.

While a full and complete description of the invention has been set forth in accordance with dictates of the Patent Statutes, it should be understood that modifications can be resorted to without departing from the spirit hereof or the scope of the appended claims.

Thus, while the invention has been described as apparatus for dispensing soap, it is believed apparent that its use need not be so limited.

What is claimed is:

1. A pump dispenser assembly, comprising:

(A) a wall mounting bracket;

(B) a top cover hingedly connected to said wall mounting bracket;

(C) a container (1) releasably received on said wall bracket and (2) releasably engaged by said top cover;

(D) a pump assembly releasably carried by said top cover and insertable into said container when said container is engaged by said top cover;

(E) said top cover including a forwardly and downwardly extending front wall terminating in an inturned lip; and (F) said container including a front wall having a transversely extending recess for engagement with said lip of said top cover.

2. The pump dispenser assembly of claim 1 wherein (A) said top cover is movable between open and closed positions with respect to said wall mounting bracket; and (B) locking means are carried by said wall mounting bracket and said top cover for releasably securing said top cover in closed position.

3. The pump dispenser assembly of claim 2 wherein said locking means include (A) said top cover including opposed resilient wall members;

(B) at least one male member carried by said wall members of said top cover; and (C) at least one female member carried by said wall mounting bracket for engagement with said male member and release therefrom upon depression of said wall members.

4. The pump assembly of claim 3 wherein said locking means are releasably carried by said wall mounting bracket and said top cover.

5. The pump dispenser assembly of claim 1 wherein (A) said wall mounting bracket includes a central, elongate body portion and an angularly extending top wall; and (B) said top cover being hingedly connected to said top wall.

6. The pump dispenser assembly of claim 1 wherein (A) said top cover is movable between open and closed positions with respect to said wall mounting bracket;

(B) said wall mounting bracket including a central elongate body portion and a bottom leg extending substantially normally from said central body portion; and (C) at least a portion of said container being received on said bottom leg when said container is engaged by said top cover and said top cover is in closed position.

7. The pump dispensing assembly of claim 1 wherein (A) said pump assembly includes an internally threaded cap; and (B) a wing nut and retainer ring combination are carried by said top cover for releasable engagement with said cap.

8. The pump dispenser assembly of claim 7 wherein (A) said pump assembly includes a supply tube; and (B) said container includes a top wall having an upwardly extending projection dimensioned for engagement with said supply tube.

9. A pump dispenser assembly, comprising;

(A) a wall mounting bracket having (1) a central body portion having front and rear surfaces, (2) opposed resilient sidewalls, (3) an angularly disposed top wall projecting upwardly and forwardly of said front surface and (4) a bottom leg extending substantially normally from said central body portion (B) a top cover hingedly connected to said top wall of said wall mounting bracket and being movable between open and closed positions and having resilient opposed sidewalls; and (C) locking means carried on the interior surfaces of said sidewalls of said wall mounting bracket and said top cover for locking said cover in closed position and releasing said cover from locking engagement upon depression of said wall members.

10. The pump dispenser assembly of claim 9 wherein a pump assembly is releasably carried by said top cover; said pump assembly including a supply tube.

11. The pump dispenser assembly of claim 10 wherein a container is releasably recevied on said bottom leg of said wall bracket and engaged by said top cover.

12. The pump assembly of claim 10 wherein (A) said top cover includes an upwardly extending wall forming a locating opening;

(B) said pump assembly includes a collar and dispensing nozzle with said collar having an external configuration corresponding to the configuration of the locating opening formed by said upwardly extending wall.

13. The pump dispenser assembly of claim 11 wherein attachment means are carried by said top cover for releasably engaging said pump assembly.

14. The pump dispenser assembly of claim 13 wherein (A) said attachment means include a body and cylindrical extension; and (B) said container includes a top wall having an upwardly extending projection dimensioned for reception of said supply tube.

15. The pump dispenser assembly of claim 13 wherein (A) said attachment means include a wing nut rotatably secured to said cover; and (B) said pump assembly includes an internally threaded cap releasably engagable with said wing nut.

16. The pump assembly of claim 9 wherein (A) said top cover includes an upwardly extending wall forming a locating opening;

(B) said pump assembly includes a collar and dispensing nozzle with said collar having an external configuration corresponding to the configuration of the locating opening formed by said upwardly extending wall.

17. The pump assembly of claim 4 wherein said locking means are releasably carried by said wall mounting bracket and said top cover.

* * * * *